United States Patent [19]

Trout

[11] 3,934,312

[45] Jan. 27, 1976

[54] METHOD OF AND APPARATUS FOR MAKING CONTINUOUS STRAND MAT

[75] Inventor: Robert G. Trout, Prairie Village, Kans.

[73] Assignee: Owens-Corning Fiberglas Corporation, Toledo, Ohio

[22] Filed: Aug. 26, 1974

[21] Appl. No.: 500,798

[52] U.S. Cl. ..... 19/66 T; 19/155; 28/1 SM

[51] Int. Cl.[2] ..... D01D 11/02

[58] Field of Search ..... 28/1 SM, 72.2 F; 19/66 T, 19/155

[56] References Cited

UNITED STATES PATENTS

| | | | |
|---|---|---|---|
| 3,060,501 | 10/1962 | Beal | 19/66 T |
| 3,120,463 | 2/1964 | Russell | 28/1 SM |
| 3,562,771 | 2/1971 | Fridrichsen | 28/1 SM |
| 3,760,458 | 9/1973 | Pitt | 19/66 T |

*Primary Examiner*—Louis K. Rimrodt

*Attorney, Agent, or Firm*—Carl G. Staelin; John W. Overman; Raymond E. Scott

[57] ABSTRACT

The present invention proposes a method of and appratus for making a mat of continuous strands of glass fibers or the like wherein each strand comprises a large number of individual filaments. The strands are deposited in mat form on a collection surface and are flooded with liquid to disperse individual filaments in the overall strand orientation. The flooded filaments are then conveyed to a drainage zone. As they are conveyed, the filaments pass through successive turbulent liquid regions wherein the filaments are locally deflected both counter-current to and con-current with the direction of conveyance, yet the general or overall strand orientation is retained. As a result, the transverse strength of the final mat is materially increased, and the mat has a multitude of fine, controllable interstices as required for some uses, e.g., asphalt-impregnated roofing mat.

7 Claims, 7 Drawing Figures

FIG. 3
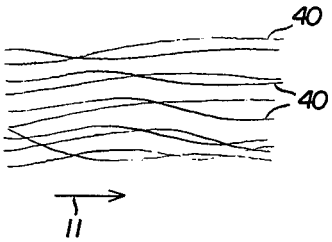
FIG. 5
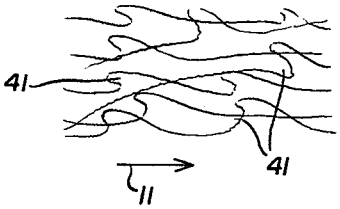
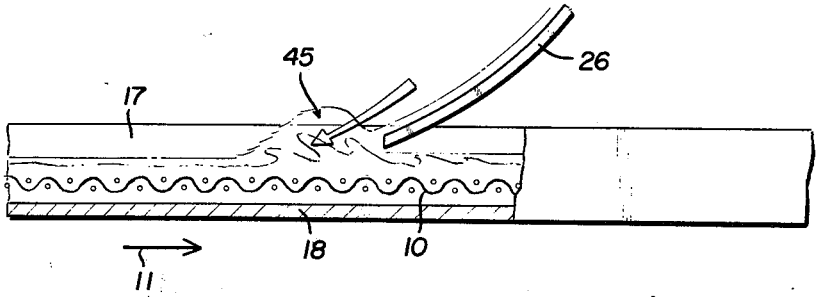
FIG. 4
FIG. 7
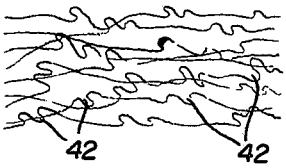
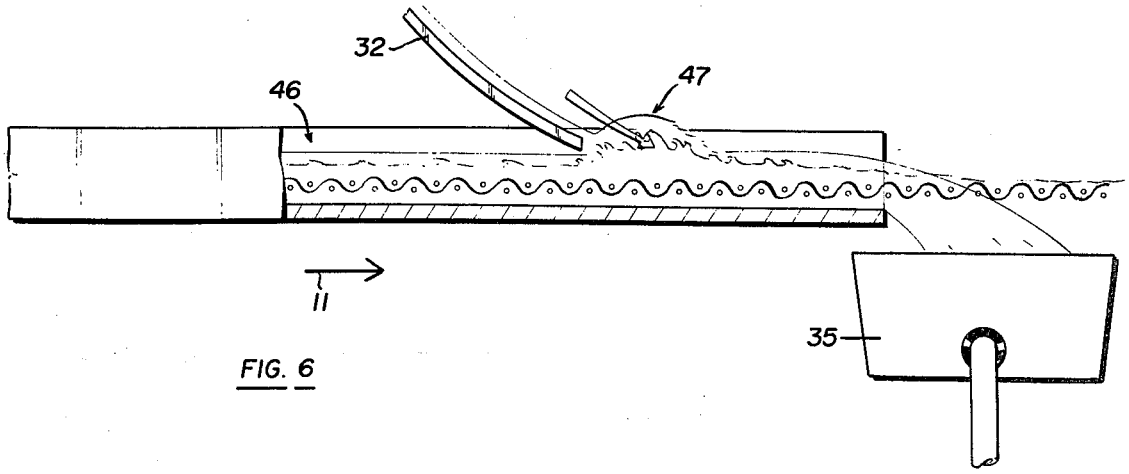
FIG. 6

METHOD OF AND APPARATUS FOR MAKING CONTINUOUS STRAND MAT

BACKGROUND OF THE INVENTION

The present invention relates to the manufacture of fibrous glass mat products and more specifically to that class of mat products known as "continuous mat." Such mats are manufactured by the deposition of continuous strands of glass fibers onto a foraminous conveyor or collection surface, the strands being deposited in overall sinuous configuration with laterally adjacent strands overlapping one another. The overall method of making such mats is well illustrated in U.S. Pat. No. 3,760,458, assigned to the assignee of the present invention. This patent illustrates the former commercial method of making continuous strand mats, and the present invention provides a specific improvement over the process and apparatus disclosed in said patent.

Typically, in a commercial operation, each strand contains 24 filaments and 360 strands are laid down in an overlapping sinuous pattern to provide a 3 foot wide mat.

In a mat of this character, the individual strands are intermingled and overlapping, but it is necessary to disperse the individual filaments of the strands so that the intermingling of the dispersed filaments is also obtained. It is this intermingling and mechanical adherence between the individual filaments, when tied together by the cured binder which gives the mat its commercially useful characteristics of (1) high strength and (2) small, uniform interstices.

In commercial practice, the foraminous conveyor travels at high speeds, on the order of 180 to 300 feet per minute and the primary orientation of the sinuous strands is longitudinally of the rapidly traveling conveyor. It is necessary to separate and disperse individual filaments from each strand while still retaining the overall sinuous configuration of the strands in order to provide both the high strength and the small, uniform interstices required in mats of this type.

This dispersion of the filaments was accomplished in the prior art, as typified by the disclosure U.S. Pat. No. 3,760,458 by flooding the strands on the conveyor with a liquid preferably containing the binder, retaining the strands in their flooded condition for a period of time sufficient to overcome the forces holding the filaments together in the strands and then draining the flooding liquid preparatory to heat curing the mat impregnated with binder.

The resultant prior art mat, of a density of 0.0225 pounds per square foot, had appreciable longitudinal tensile strengths, on the order of 150 pounds per square inch, but was of relatively low transverse strength, generally about 80 to 90 pounds per square inch. Further, the interstices of the prior art mat were not uniform and were relatively large particularly in the longitudinal direction. If it were possible to increase the transverse strength of continuous strand mats and to provide more uniform, smaller interstices therein, a more desirable commercial product could be obtained.

BRIEF DESCRIPTION OF THE PRESENT INVENTION

The present invention constitutes a specific improvement over the apparatus and method disclosed in U.S. Pat. No. 3,760,458, in that the method and apparatus of the present invention provide for better dispersion of the individual filaments in a continuous strand mat to both increase the transverse strength of the mat and to provide smaller, more uniform interstices therein.

Specifically, the present invention provides for the creation of successive turbulent liquid regions through which the flooded mat strands are conveyed to locally deflect individual filaments of the strands longitudinally and transversely of the direction of travel of the strands and filaments through the flooding zone. Such local deflection still retains the general or overall strand orientation within the mat but increases the transverse strength of the final mat and provides a multitude of fine, controllable interstices in the mat.

The method of the present invention includes the initial deposition of multifilament strands in an overall sinuous pattern on a movable collection surface, as in the prior art. The strands are flooded in the present invention by passing liquid, preferably containing a binder, upwardly through the collection surface to flood the strands. The flooded strands then are conveyed in a relatively quiescent condition, so that the filaments of each strand tend to disperse while the initial overall sinuous pattern of the strands is retained. After initial dispersion of the filaments, a counter-current stream of additional liquid is vertically impinged upon the flooded strands to create a localized turbulent flow of liquid which displaces at least some of the filaments of each strand in directions (1) counter to the direction of movement of the support surface and (2) transverse to the surface movement. This counter-current impingement with additional liquid disperses and deflects the individual filaments so that they are better intermingled with one another both transversely and longitudinally, but the dispersement is localized and controlled by the fact that it takes place while the filaments are flooded.

After passing through a quiescent zone, the dispersed filaments are still further dispersed by impingement with a second vertically flowing stream of liquid, which, preferably, is flowing in the direction of movement of the support surface. This second or additional impingement further disperses the filaments and tends to double the filaments longitudinally upon themselves to increase the longitudinal and lateral localized dispersion of the filaments while still retaining the essential overall sinuous configuration of the strands as they were originally laid down upon the support surface.

If desired or necessary, a second counter-current stream of liquid can be utilized, such second stream preferably being interposed between the first counter-current stream and the later con-current stream.

As the results of the successive subjection of the filaments (1) to quiescent filament separation from the original strands, (2) to turbulent local longitudinal and transverse dispersion and separation, (3) to quiescent travel in their dispersed condition, and (4) to final further vertical impingement to effect still further dispersion, the filaments are separated to a greater degree than in the prior art, and the filaments are intermingled and mechanically interlocked to a greater degree than in the prior art. As a result, the transverse strength of the mat is substantially increased and the uniformity of the interstices in the final mat is substantially enhanced. For example, typical strengths in mats made by the present invention, and of 0.0225 pound per square foot density, will have longitudinal strengths on the order of 125 pounds per square inch and transverse strengths on the order of 115 pounds per square inch.

The improvement in transverse strength will be apparent.

It is, therefore, an important object of the present invention to provide an improved method of and apparatus for making continuous strand mats having enhanced strengths and finer interstices that the prior art mat.

Another important object of this invention is the provision of a method of making a continuous strand mat wherein individual filaments of each strand are dispersed to a greater degree than heretofore possible and wherein the individual filaments are locally dispersed within a controlled overall strand configuration resulting from the initial mat formation.

It is a further, no less important, object of the present invention to provide an improved method of and apparatus for making the mat comprising multi-filament strands and wherein the strands are supported on the moving support surface and flooded with liquid to disperse the individual filaments, and the flooded filaments are further dispersed within the overall strand configuration by impingement of successive, oppositely directed liquid streams producing turbulent flooding conditions displacing individual filaments both longitudinally and laterally of the overall initial strand orientation.

Other and further objects of the present invention will be, apparent from the appended detailed description of the invention and the attached claims.

ON THE DRAWINGS

FIG. 3 is a fragmentary sectional view taken along the plane 3-3 and showing the orientation of the strands in the initial flooding zone;

FIG. 4 is a fragmentary side elevational view showing the formation of the initial turbulent zone caused by the vertical impingement of liquid on the flooded strands;

FIG. 5 is a fragmentary sectional view similar to FIG. 3 and illustrating the filament configuration as the strands issue from the first turbulent zone;

FIG. 6 is a view similar to FIG. 4 but illustrating the formation of a second turbulent zone; and FIG. 7 is a view similar to FIGS. 3 and 4 showing the final configuration of the filaments immediately prior to drainage of the liquid.

AS SHOWN ON THE DRAWINGS

Figure 1:
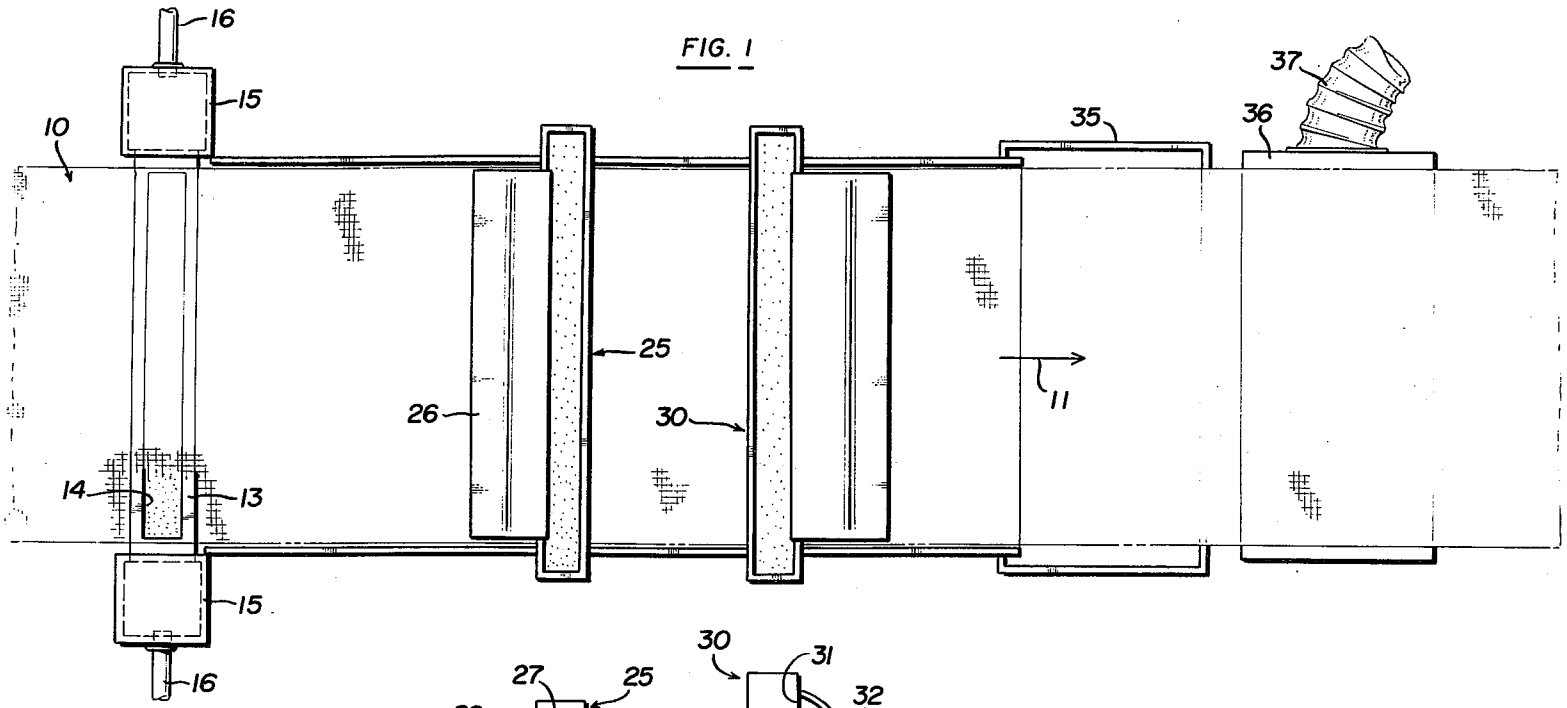
FIG. 1 is a fragmentary plan view of an apparatus of the present invention capable of carrying out the method of the present invention.
Figure 2:
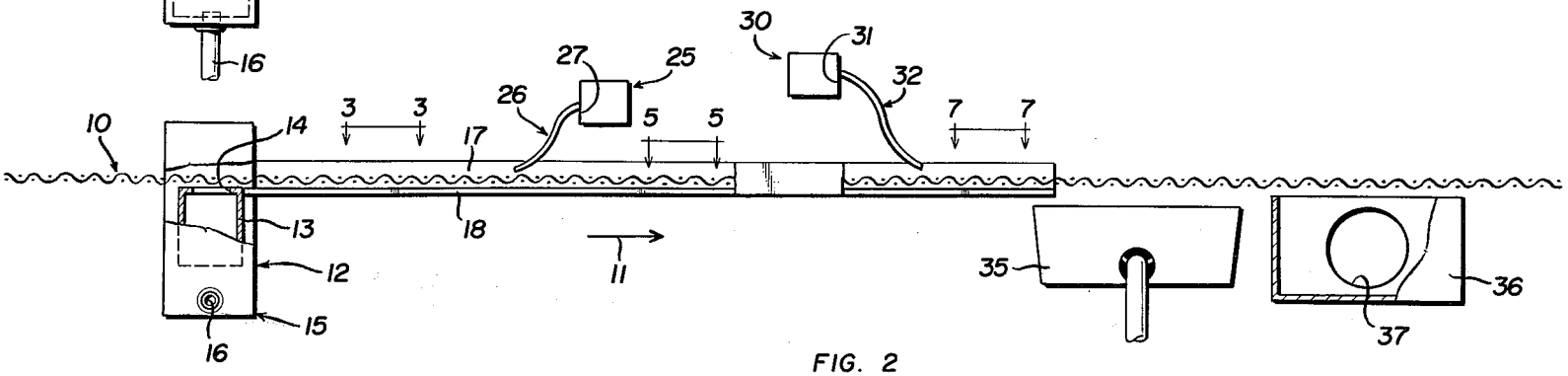
FIG. 2 is a side elevational view of the apparatus of FIG. 1, with parts broken away and in section.

FIGS. 1 and 2 were schematic representations with a portion of the apparatus utilized to make continuous strand mats. As above explained, the present invention is a specific improvement on the apparatus shown in U.S. Pat. No. 3,760,458. This earlier patent illustrates and describes therein the apparatus and method for forming the continuous strands and for laying these strands upon a movable, foraminous collection surface. The apparatus of this earlier patent is utilized as part of the present invention, and the disclosure of the present invention is limited to the improvements made in the overall apparatus of U.S. Pat. No. 3,760,458.

As explained in said patent, strands of continuous glass fibers are laid down upon a foraminous belt-type conveyor 10 driven by suitable means in the direction of directional arrow 11.

The foraminous conveyor 10 passes over the flooding apparatus indicated generally at 12 and comprising a rectangular box 13 disposed beneath the conveyor 10, the box 13 having an elongated slot 14 in the upper surface thereof closely underlying the belt 10. The box 13 and the slot 14 therein are substantially coextensive with the transverse extent of the conveyor 10, the box 13 opening on each of its extremities onto vertical reservoirs 15 and extending vertically upwardly beyond the extent of the box 13 on either side of the conveyor 10. Each vertical reservoir 15 receives a liquid through lower pipe 16 located at the lower extremity thereof.

The liquid supplied to the reservoir 15 through the conduits 16 flows into the box 13 to be dispensed upwardly through the slot 14 onto the undersurface of the traveling conveyor 10. The speed of travel of the conveyor 10 is appreciable, varying from 180 to 300 feet per minute, and the amount of liquid pumped into the reservoirs 15 and dispensed into slot 14 is also appreciable, for example, as much as 160 gallons per minute at convey or speeds of 300 feet per minute. The reservoirs 15 extending above the conveyor adjacent each end thereof dampen the turbulence which otherwise would result from this high flow rate of liquid.

As the liquid flows upwardly through the slot 14, it is immediately conveyed in the direction of the arrow 11 by the fast moving conveyor 10, and the conveyor, together with the strands disposed thereon, are immediately flooded by this liquid. The conveyor 10, the flooding liquid and the strands all move together and at the same speed in the direction of the arrow 11. Side plates 17 retain the flooding liquid upon the surface of the conveyor, and a water impermeable lower support surface 18 on which the conveyor travels prevents any vertical drainage of the liquid from the conveyor 10.

Since there is no relative motive between the liquid, the conveyor 10 and the strands 40, the strands 40 are flooded in an initial quiescent zone. Thus, the flooded strands tend to segregate into individual filaments, yet the strand configuration is not disturbed and the segregation into individual filaments stays in the overall sinuous pattern of the strands as they were deposited on the conveyor 10, in accordance with the disclosure of the above identified earlier patent. This condition is illustrated in FIG. 3 of the drawings, wherein it will be seen that the filaments tend to lie in their original sinuous configuration, i.e., the configuration in which they were laid down upon the conveyor 10 prior to flooding.

Overlying the conveyor 10, as illustrated in FIGS. 1 and 2, is a weir trough indicated generally at 25, this trough extending completely across the transverse extent of the conveyor 10. The trough 25 is held filled with liquid preferably the same liquid as flows through the reservoirs 15 and the box 13, and this liquid spills over the vertical front or weir wall 27 for flow over an impingement plate 26 onto the flooded filaments lying on the surface of the conveyor 10. The impingement plate 26 forms a compound parabolic curve terminating above the conveyor 10. From the plate 26, the liquid is to contact the flood liquid upstream of the plate at an acute angle to the direction of movement of the liquid flooding the filaments and traveling with the conveyor 10. The direction of flow of liquid from the lip of the impingement plate 26 is counter-current to the direction of travel of the flood water directly beneath. As the impingement water strikes the surface of the flood water, it forms a turbulent zone 45 extending transversely across the entire width of the conveyor 10. As a result, the somewhat violent localized turbulent zone 45 is created on the upstream side of the impingement plate 26.

This turbulent zone 45 is best illustrated in FIG. 4 of the drawings, and it will be seen that this zone extends upstream from the lip plate 26 to lie at a height above the lip of the plate, the resultant turbulence extending down into the flood liquid over the filaments and tending to impede the progress of the filaments with the flood liquid and the conveyor beneath the lip of the impingement plate. As a result, the filaments which had been previously dispersed from their strand configurations, are deflected both longitudinally and laterally by this turbulent zone. By virtue of the counter-current direction of flow of the impinging liquid from the plate 26, most of the turbulence will be longitudinally of the direction of travel of the conveyor 10, although appreciable transverse turbulence will necessarily result.

The turbulent zone is limited by the high velocity travel of the flood liquid with the conveyor 10, the impinging liquid being reversed into direction and swept underneath the lip of the plate 16 by the onrushing flood liquid carried by the conveyor 10. The extent of turbulence is governed by the height of the weir wall 27 and the volume of liquid striking the surface, in other words by the pressure and flow rate at which the liquid issues from the lip of the plate 26 onto the flood liquid. As illustrated in FIG. 4, and in FIG. 5 as well, the individual filaments are turned back upon themselves by the counter-current impingement of water dropping from the lip of the plate 26, the individual filaments being looped both longitudinally and transversely by the impediment to their progress in the direction 11 provided by the curtain of impingement water falling from the lip of the plate 26.

The filaments still lie in their overall sinuous pattern which was determined by the initial laying down pattern of the strands. However, after passing through the turbulent zone immediately upstream of the impingement plate 26, the filaments are dispersed to a much greater degree, and the dispersed filaments are deflected both longitudinally and laterally from their initial sinuous patterns.

Next, the conveyor 10 carries the dispersed filaments beneath the trough 25 into a second quiescent zone in which the filaments are retained in that dispersed condition which they gained during passage through the turbulence zone. The water which originally flowed down the plate 26 into the turbulence zone is swept beneath the trough 25 and into a relatively quiescent zone at the same velocity as the conveyor 10 so there is no substantial relative movement between the liquid, the strand filaments, and the conveyor 10 in this quiescent zone.

Next, the filaments in the flood liquid in which the filaments are borne passes beneath a second trough 30 similar to the first trough 25 and having a weir wall 31 somewhat higher level than the weir wall 27, liquid spilling over the weir wall 31 for travel over a second compound parabolic impingement plate 32 having a lower lip from which the liquid falls onto the surface of the flood liquid. The second impingement plate 32 is directed in the direction of travel of the conveyor 10 and so the impingement is con-current with the direction of travel of the flood liquid and of the filaments as determined by the travel of the conveyor 10 in the direction 11. The liquid spilling from the lower lip of the impingement plate 32 creates a second turbulent zone in the flood liquid, but this zone is less turbulent than the first turbulent zone, since the direction of flow of the impinging liquid is in the same direction as the flow of the flood liquid. The increased velocity flow which results from the impingement of the con-current liquid flows effects relative movement of the filaments in the flood liquid and pushes the filaments downstream in a direction reversed to the displacement of the filaments by virtue of the first impingement from the plate 26. As a result, the filaments are again dispersed both longitudinally and transversely of the conveyor 10, but primarily longitudinally.

The further longitudinal displacement of the filaments relative to the flood liquid is enhanced by the fact that the lower impervious support plate 18 terminates immediately after the second turbulence zone of liquid flowing over the edge of the plate 18 into a drain pan 35. This again effects relative motion between the filaments retained on the foraminous conveyor 10 and the liquid flowing through the foraminous conveyor 10. As a result, the filaments are displaced longitudinally and somewhat transversely in the second turbulence zone created by the flow of liquid from the plate 32, and the rush of liquid through the foraminous plate into the drain box fixes the filaments to the foraminous surface 10 in their displaced condition. Finally, the additional liquid is extracted from the filaments and the interstices between the filaments and from the foraminous surface 10 itself through a vacuum box 36 downstream of the drain box 35 and connected, as by conduit 37, to a suitable source of vacuum.

In summary, it will be seen that the multifilament strands were first laid down on the foraminous conveyor 10 by the strand forming and laying means illustrated in U.S. Pat. No. 3,760,458. The strands are then flooded from beneath through the reservoirs 15 and the box 13 and the relatively quiescent con-current flow of the flood liquid, the conveyor and the strands allows the filaments of the strands to segregate and separate while still retaining the sinuous overall strand configuration.

Next, the generation of turbulence in the flood water by the counter-current flow of liquid over the weir wall 37 and down the impingement plate 26 displaces individual filaments transversely and longitudinally relative to one another and relative to the original strand configuration, the impingement and turbulence also separating the individual filaments to an even greater degree. A second quiescent zone allows the filaments to retain their displaced condition until second turbulence zone is entered, at which time the filaments are displaced primarily longitudinally in the direction of flood liquid movement by the flow of liquid from the second impingement surface 32. The flood liquid is immediately thereafter drained from the filaments to leave the filaments upon the foraminous support surface in a well dispersed configuration still conforming generally to the initial sinuous strand formation and yet with sufficient longitudinal and transverse dispersion to provide the enhanced transverse strength and the uniform, multitudinous interstices of the mat as heretofore described.

The strands are subsequently heated as described in U.S. Pat. No. 3,760,458 to form the final bonded mat.

As above explained, the present invention forms a specific improvement on the process and method disclosed in U.S. Pat. No. 3,760,458 and reference is made to this patent for disclosure of the liquids, lubricants, binders, etc. which may be utilized as the flood liquid. Preferably, the liquid impinged from the plates 26,32 onto the flood liquid is the same as the flood liquid, although this is not necessary, as explained in the above identified patent.

If desired, additional impingement of liquid onto the flood liquid can be carried out by the installation of additional weirs and plates similar to the plates 26,32. The creation of additional turbulence zones by the installation of such additional impingement mechanism would further vary the initial sinuous configuration of the filaments. Even if additional such turbulence zones were created, the essential process of the present invention would still be carried out by providing successive turbulent zones separated by quiescent zones, with the degree of turbulence and the amount of deflection of the filaments being governed by whether the impingement of additional liquid on the flood liquid occurs in a counter-current or con-current fashion.

I claim:

1. In a method of making a fibrous strand mat, the steps of: (1) depositing multifilament strands in an overall sinuous pattern on a movable foraminous collection conveyor, (2) moving said conveyor in a first direction over a non-foraminous support, (3) passing a liquid upwardly through said conveyor to flood the strands on said conveyor with said liquid, (4) conveying the liquid and the strands with the conveyor over said support at substantially the same speed so that the filaments of each strand tend to disperse while retaining the initial overall sinuous pattern of said strands, (5) vertically impinging a counter-current stream of additional liquid onto the flooded strands supported on said conveyor to create a localized turbulent flow of liquid displacing at least some of the filaments of each strand in a direction counter to the direction of movement of said conveyor, thereby locally dispersing said filaments from the initial overall sinuous pattern of said strands, (6) conveying the additional liquid and the dispersed strands with the conveyor from the region of localized turbulent flow to retain the filaments as locally dispersed, (7) vertically impinging a con-current second stream of additional liquid onto the flooded strands, the second stream creating a second localized turbulent flow of liquid displacing at least some of the filaments of said strands in the direction of movement of the conveyor, thereby further locally dispersing such filaments, and (8) moving said conveyor bearing the liquid and the dispersed filaments therein beyond said non-foraminous support to permit the flow of liquid through said conveyor, leaving the dispersed filaments on said conveyor in the form of a mat.

2. In a method of making a fibrous strand mat, by flooding with liquid multi-filament strands of glass fibers supported on a collection surface to disperse the filaments of each strand in the overall orientation of the strands and moving the surface bearing the liquid and the strands toward a liquid removal location, the improvement of:

passing the strands while still flooded with liquid and while still supported on said collection surface through successive localized areas of liquid turbulence displacing at least some of the filaments of each strand first in a direction generally counter to the direction of movement of the surface and then in a direction generally the same as the direction of movement of said surface, so that the filaments are locally dispersed both laterally and longitudinally from the initial overall orientation of the strands.

3. In a method of making a continuous strand mat, wherein multi-filament strands are laid down in a predetermined pattern on a foraminous conveyor for travel through a flooding zone to a drainage zone, the steps of (1) passing liquid upwardly through the conveyor to flood the strands with liquid, (2) conveying the flooded strands toward the drainage zone with minimum relative liquid-strand movement to separate at least some of the strands, into components filaments while essentially retaining the filaments in place in said pattern, (3) impinging additional liquid on the flooded strands with appreciable velocity in a direction counter-current to the direction of flooded strand travel (a) to generate a localized liquid turbulence through which the conveyor and the flooded filaments must travel and (b) to effect relative liquid-filament movement primarily longitudinally but also transversely of the direction of primary strand travel, and (4) further impinging still additional liquid on the flooded strands with appreciable velocity (a) to generate further localized liquid turbulence and (b) to effect further relative liquid-filament movement, and (5) passing said conveyor through said drainage zone to remove the flooding liquid.

4. In a method of making a fibrous strand mat, by flooding with liquid multi-filament strands of glass fibers supported on a collection surface to dispense the filaments of each strand in the overall orientation of the strands and moving the surface bearing the liquid and the strands toward a liquid removal location, the improvement of:

passing the strands while still flooded with liquid and while still supported on said collection surface through a localized area of liquid turbulence displacing at least some of the filaments of each strand in a direction generally counter to the direction of movement of the surface so that the filaments are locally dispersed both laterally and longitudinally from the initial overall orientation of the strands.

5. In a method of making a fibrous strand mat wherein multi-filament strands are deposited in an overall sinuous pattern on a movable foraminous collection conveyor, said conveyor is moved in a first direction over a non-foraminous support, a liquid flows upwardly through said conveyor to flood the strands travel with the conveyor over said support at substantially the same speed so that the filaments of each strand tend to disperse while retaining the initial overall sinuous pattern of said strands and finally said conveyor bearing the liquid and the strands thereon moves beyond said non-foraminous support to permit the flow of liquid through said conveyor, leaving the strands on said conveyor in the form of a mat, the improvement residing in the steps of (1) vertically impinging a counter-current stream of additional liquid onto the flooded strands supported on said conveyor to create a localized turbulent flow of liquid displacing at least some of the filaments in a direction counter to the direction of movement of said conveyor, thereby locally dispersing said filaments from the initial overall sinuous pattern of said strands, (2) conveying the additional liquid and the dispersed filaments with the conveyor from the region of localized turbulent flow to retain the filaments as locally dispersed, and (3) vertically impinging a con-current second stream of additional liquid onto the flooded strands, the second stream creating a second localized turbulent flow of liquid displacing at least some of the filaments of said strands in the direction of movement of the conveyor, thereby further locally dispersing such filaments.

6. In a method of making a continuous strand mat, wherein multi-filament strands are laid down in a predetermined pattern on a foraminous conveyor for travel through a flooding zone to a drainage zone and wherein the strands are flooded with liquid, and flooded strands are conveyed toward the drainage zone with minimum relative liquid-strand movement to separate at least some of the strands into the component filaments while essentially retaining the filaments in place in said pattern, the improvement of impinging additional liquid on the flooded strands with appreciable velocity in a direction counter-current to the direction of flooded strand travel (a) to generate a localized liquid turbulence through which the conveyor and the flooded filaments must travel and (b) to effect relative liquid-filament movement primarily longitudinally but also transversely of the direction of primary strand travel.

7. In an apparatus for making a fibrous strand mat including a foraminous collection conveyor, means for depositing multi-filament strand in an overall sinuous pattern on the conveyor, a non-foraminous-support underlying the conveyor, means for flooding the strands on the conveyor with a liquid, and means for displacing the conveyor with the flood liquid and the strands thereon over said support to a drainage location, the improvement of means overlying said conveyor for vertically impinging a counter-current stream of additional liquid onto the flooded strands supported on the conveyor, and means spaced from said first means for vertically impinging a con-current second stream of additional liquid onto the flooded strands.

* * * * *